US008371514B2

(12) United States Patent
Finell

(10) Patent No.: US 8,371,514 B2
(45) **Date of Patent: *Feb. 12, 2013**

(54) SPOUT COVER

(75) Inventor: Rebecca M. Finell, Tempe, AZ (US)

(73) Assignee: BKD Acquisition, Inc., Oak Brook, IL (US)

( * ) Notice: Subject to any disclaimer, the term of this patent is extended or adjusted under 35 U.S.C. 154(b) by 14 days.

This patent is subject to a terminal disclaimer.

(21) Appl. No.: 12/557,415

(22) Filed: Sep. 10, 2009

(65) Prior Publication Data

US 2010/0001021 A1 Jan. 7, 2010

Related U.S. Application Data

(63) Continuation of application No. 11/429,091, filed on May 5, 2006, now Pat. No. 7,588,197.

(60) Provisional application No. 60/700,471, filed on Jul. 19, 2005.

(51) Int. Cl.

| | |
|---|---|
| ***B05B 15/00*** | (2006.01) |
| ***B05B 15/04*** | (2006.01) |
| ***B05B 7/26*** | (2006.01) |
| ***B05B 9/043*** | (2006.01) |
| ***B05B 1/30*** | (2006.01) |

(52) U.S. Cl. ..... 239/289; 239/314; 239/288; 239/571; 239/315; 239/316; 239/333

(58) Field of Classification Search ..... 239/571, 239/288, 288.3, 289, 211, 310, 314, 315, 239/316, 329, 330, 333, 17; 222/173, 628, 222/630, 631, 20, 110, 162, 380, 387; D23/227, D23/256; D6/542, 545; 4/678

See application file for complete search history.

(56) References Cited

U.S. PATENT DOCUMENTS

| | | | | | |
|---|---|---|---|---|---|
| 1,232,930 | A | * | 7/1917 | Kennedy | 222/110 |
| 2,564,618 | A | * | 8/1951 | Williams | 239/416.5 |
| 2,625,430 | A | * | 1/1953 | Murphy | 239/314 |
| 2,928,422 | A | * | 3/1960 | Hunsinger | 137/597 |
| 3,090,565 | A | * | 5/1963 | Brown | 239/542 |
| 3,098,503 | A | * | 7/1963 | Hunsinger | 137/597 |
| 3,133,701 | A | * | 5/1964 | McClenahan | 239/25 |
| 3,140,829 | A | * | 7/1964 | Rose | 239/318 |
| 3,409,230 | A | * | 11/1968 | Eelkema | 239/314 |
| 3,563,468 | A | * | 2/1971 | Holzinger | 239/318 |
| 3,623,638 | A | * | 11/1971 | Henning et al. | 222/78 |
| 3,807,453 | A | * | 4/1974 | Dom et al. | 137/625.17 |
| 4,084,607 | A | * | 4/1978 | Fagert et al. | 137/312 |
| 4,131,232 | A | * | 12/1978 | Pollinzi | 239/314 |
| 4,353,139 | A | * | 10/1982 | Wainwright et al. | 4/661 |
| 4,552,171 | A | * | 11/1985 | Farrell et al. | 137/359 |
| 4,709,429 | A | * | 12/1987 | Lerner et al. | 4/661 |
| 4,821,960 | A | * | 4/1989 | Goldman | 239/211 |
| 4,840,311 | A | * | 6/1989 | Shamblin | 239/74 |
| 4,921,171 | A | * | 5/1990 | Cupit | 239/314 |
| 4,956,883 | A | * | 9/1990 | Lane | 4/605 |
| 5,125,577 | A | * | 6/1992 | Frankel | 239/211 |
| 5,337,956 | A | * | 8/1994 | Crutcher | 239/27 |

(Continued)

*Primary Examiner* — Jason J Boeckmann
*Assistant Examiner* — Steven M Cernoch
(74) *Attorney, Agent, or Firm* — Michael Best & Friedrich LLP

(57) ABSTRACT

A spout cover for a spout having an outlet end includes a first member, having a deflector, mounted to a second member having a liquid soap reservoir and a dispenser for dispensing liquid soap from the liquid soap reservoir toward the deflector. A receiving area is defined between the first and second members for receiving the spout. The first member is movable relative to the second member between a first position permitting the spout to be received in the receiving area and a second position locating the deflector underneath the outlet end of the spout and preventing withdrawal of the spout from the receiving area.

13 Claims, 10 Drawing Sheets

U.S. PATENT DOCUMENTS 5,356,076 A * 10/1994 Bishop ..... 239/311
D354,550 S * 1/1995 Munoz ..... D23/256
5,505,380 A * 4/1996 Jun ..... 239/211
5,620,032 A * 4/1997 Dame ..... 141/311 A
6,409,099 B1 * 6/2002 Goodwin et al. ..... 239/310
6,827,294 B1 * 12/2004 Fan et al. ..... 239/310
6,923,384 B2 * 8/2005 Cernik ..... 239/318
7,588,197 B2 * 9/2009 Finell ..... 239/289
7,818,830 B2 * 10/2010 Thorne et al. ..... 4/675
2002/0033424 A1 * 3/2002 Rivera et al. ..... 239/310
2004/0050964 A1 * 3/2004 Wong et al. ..... 239/337
2004/0238660 A1 * 12/2004 Fan et al. ..... 239/310

* cited by examiner 50
51
52
53
54
56
60
61
65
80
81
82
110
111
113
130
132
140
141
142
144
145
152
170
180
195
196
211

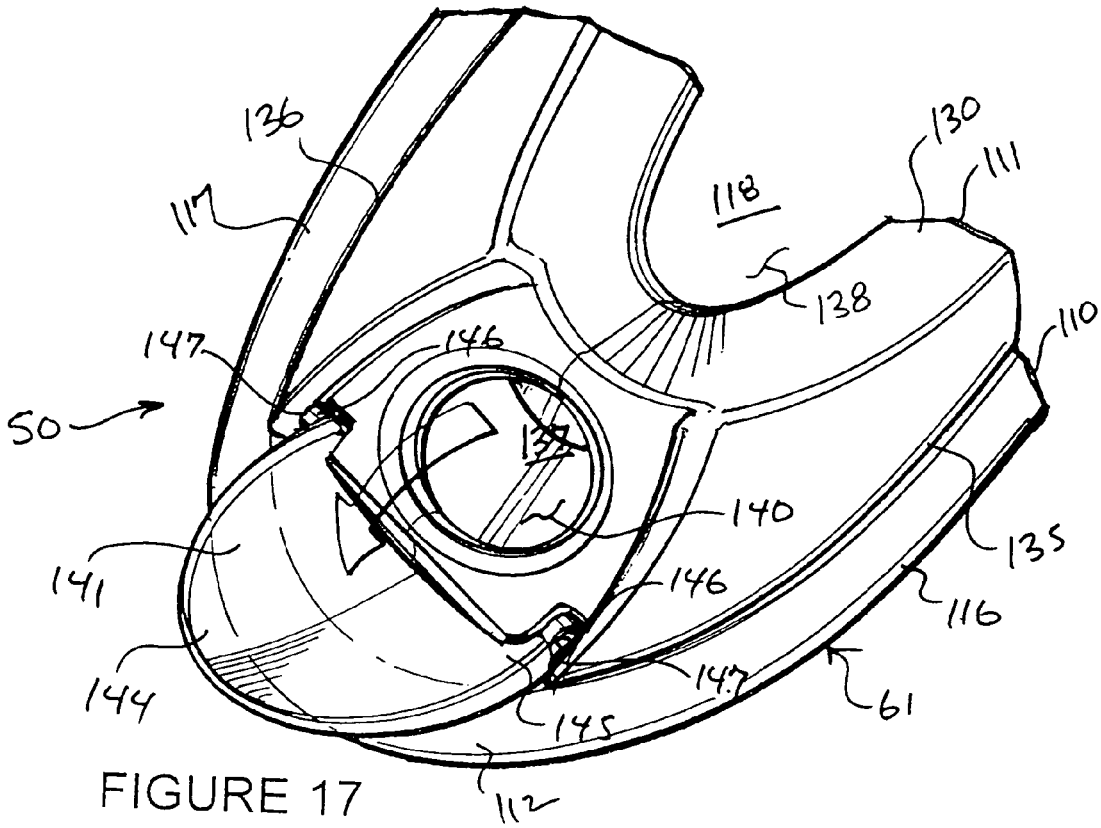
FIGURE 17
FIGURE 23
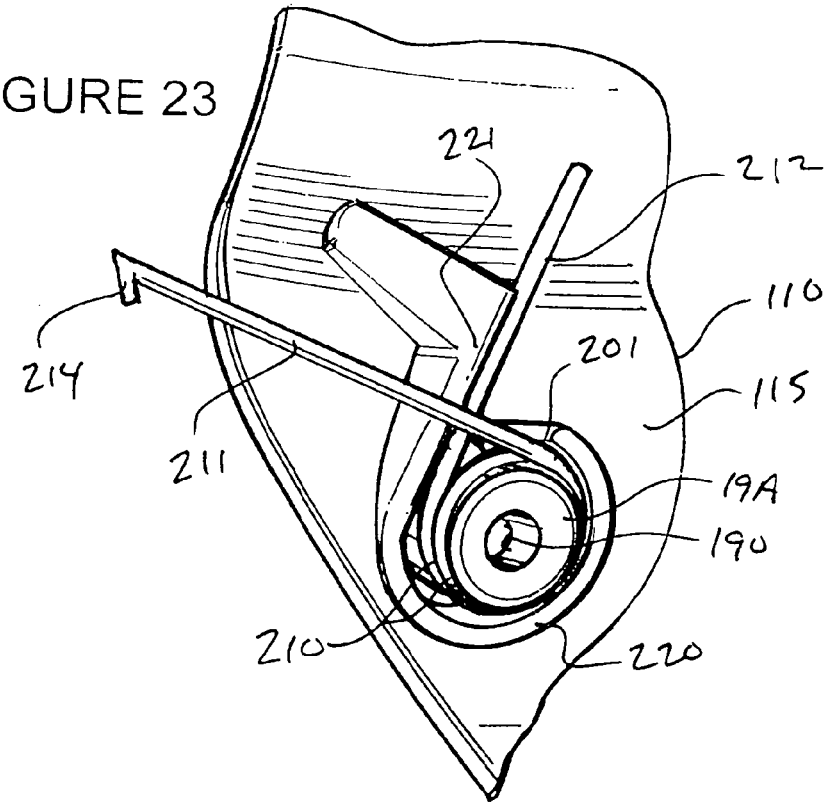

SPOUT COVER

CROSS REFERENCE TO RELATED APPLICATION

This application claims the benefit of U.S. Provisional Application No. 60/700,471, filed Jul. 19, 2005.

FIELD OF THE INVENTION

The present invention relates to spouts and, more particularly, to spout covers.

BACKGROUND OF THE INVENTION

The prior art is replete with spout covers, which are placed over a spout such as a tub or sink spout. Some prior art spout covers are designed to substantially conceal the spout and provide it with a selected decorative appearance. Other prior art spout covers hold liquid soap, such as liquid bathing soap or liquid bubble bath.

Many spout covers are designed as sleeves, which are forcibly pushed over the spout. A number of "sleeve-type" spout covers are typically formed in the shape of an animal head, a human head, or other selected shape. It is noted that other sleeve-type faucet covers are more utilitarian in nature providing concealment of the spout with a soft, deformable sheath that also protects users from pain an injury that can otherwise occur from hitting their heads, elbows, or knees against the spout.

The prior art has provided numerous specific configurations of spout covers. None, however, have proven to be entirely satisfactory. Many are difficult to install onto a spout and difficult to remove. Others are relatively easy to install onto a spout, but also easily fall off. Frequently, the prior art spout covers are inconvenient and cumbersome to operate, difficult to construct, and hard to clean. Those prior art spout covers capable of providing a source of liquid soap do not provide a user with controlled access to the liquid soap, and frequently automatically introduce liquid soap into the water stream without providing a way to allow a user to control the amount of liquid soap introduced into the water stream.

SUMMARY OF THE INVENTION

It would be highly advantageous, therefore, to remedy the foregoing and other deficiencies inherent in the prior art. Accordingly, it is an object of the present invention to provide a spout cover incorporating opposed first and second members that clamp onto a spout which is simple in structure, which is low in cost, which is safe, in which the first member is movable relative to the second member between a first position permitting the spout to be received in a receiving area defined between the first and second members and a second position preventing withdrawal of the spout from the receiving area, and in which the second member incorporates a liquid soap dispenser for dispensing soap from a liquid soap reservoir formed in the second member toward a deflector of the first member for allowing the liquid soap to mix with water applied to the deflector from the spout.

Briefly, to achieve the objects and advantages of the instant invention, in accordance with a preferred embodiment thereof, a spout cover for a spout having an outlet end is provided, which includes a first member mounted to a second member having a liquid soap reservoir and a dispenser for dispensing liquid soap from the liquid soap reservoir. A receiving area is defined between the first and second members for receiving the spout, and the first member is movable relative to the second member between a first position permitting the spout to be received in the receiving area and a second position preventing withdrawal of the spout from the receiving area. A bias, provided by one or more springs, is applied to the first member biasing the first member into the second position. Preferably, a flap valve is provided for the dispenser. The spout includes a spigot projecting outwardly therefrom, and there is an access opening formed in the second member for providing user access to the spigot when the spout is received in the receiving area and the first member is disposed in the second position preventing withdrawal of the spout from the receiving area. The second member consists of a generally annular body defining the access opening. The liquid soap reservoir is formed in the generally annular body. The first member carries a deflector, which underlies the dispenser, in which the dispenser is further for dispensing liquid soap from the liquid soap reservoir toward the deflector. The second member carries a resilient boot for frictionally retaining the second member to the spout when the spout is received in the receiving area and the first member is disposed in the second position preventing withdrawal of the spout from the receiving area.

According to the invention, a spout cover for a spout having an outlet end is provided, which includes a first member, having a deflector, mounted to a second member having a liquid soap reservoir and a dispenser for dispensing liquid soap from the liquid soap reservoir toward the deflector. A receiving area is defined between the first and second members for receiving the spout, and the first member is movable relative to the second member between a first position permitting the spout to be received in the receiving area and a second position locating the deflector underneath the outlet end of the spout and preventing withdrawal of the spout from the receiving area. A bias, provided by one or more springs, is applied to the first member biasing the first member into the second position. Preferably, a flap valve is provided for the dispenser. The spout includes a spigot projecting outwardly therefrom, and an access opening is formed in the second member for providing user access to the spigot when the spout is received in the receiving area and the first member is disposed in the second position preventing withdrawal of the spout from the receiving area. The second member consists of a generally annular body defining the access opening. The liquid soap reservoir is formed in the generally annular body. The second member carries a resilient boot for frictionally retaining the second member to the spout when the spout is received in the receiving area and the first member is disposed in the second position preventing withdrawal of the spout from the receiving area.

According to the invention, a spout cover for a spout having an outlet end is provided, which includes a first member, having a deflector, mounted to a second member, and a receiving area defined between the first and second members for receiving the spout. The first member is movable relative to the second member between a first position permitting the spout to be received in the receiving area and a second position locating the deflector underneath the outlet end of the spout and preventing withdrawal of the spout from the receiving area. A bias, provided by one or more springs, is applied to the first member biasing the first member into the second position thereof. The spout includes a spigot projecting outwardly therefrom, and an access opening is formed in the second member for providing user access to the spigot when the spout is received in the receiving area and the first member is disposed in the second position preventing withdrawal of the spout from the receiving area. The second member carries a resilient boot for frictionally retaining the second member to the spout when the spout is received in the receiving area and the first member is disposed in the second position preventing withdrawal of the spout from the receiving area.

According to the invention, a combination spout and spout cover assembly is provided, which includes a first member having a deflector, and a second member mounted to the first member. The second member has a liquid soap reservoir and a dispenser for dispensing liquid soap from the liquid soap reservoir toward the deflector. A receiving area is defined between the first and second members, and a spout, having an outlet end, is located in the receiving area. The first member is movable relative to the second member between a first position releasing the spout and a second position clamping the spout between the first and second members, locating the deflector underneath the outlet end of the spout, and preventing withdrawal of the spout from the receiving area, wherein the deflector receives water ejected from the outlet end of the spout and deflects the water outwardly therefrom. A bias, provided by one or more springs, is applied to the first member biasing the first member into the second position. Preferably, the dispenser is a flap valve. An access opening is formed in the second member, the spout includes a spigot projecting outwardly therefrom, and the spigot is located at the access opening. The second member consists of a generally annular body defining the access opening. The liquid soap reservoir is formed in the generally annular body. The second member carries a first resilient element frictionally retaining the second member to the spout, and the first member carries a second resilient element frictionally retaining the first member to the spout.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings:

FIG. 17 is an enlarged fragmentary perspective view of the second member of FIG. 8 showing the lid as it would appear in the open position opening the inlet to the liquid soap reservoir;

FIG. 23 is an enlarged fragmentary perspective view of a spring of the coupling of FIG. 22 operative for applying a bias to the first member of the spout cover of FIG. 1.

DETAILED DESCRIPTION OF PREFERRED EMBODIMENTS

Figure 1:
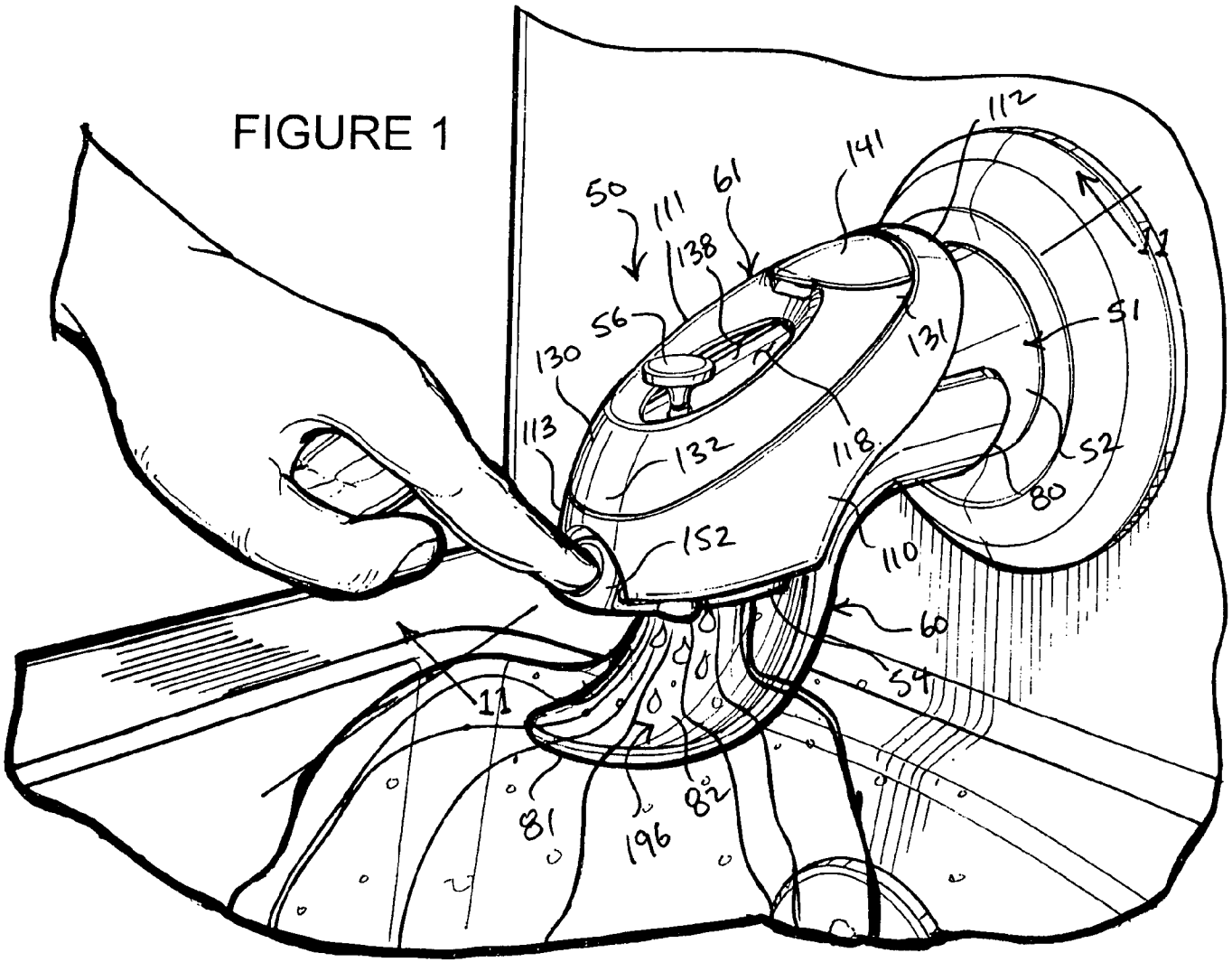
FIG. 1 is a perspective view of a spout cover, constructed and arranged in accordance with principle of the invention, shown as it would appear in use attached to a spout, the spout cover including a first member, having a deflector, mounted to a second member having a liquid soap reservoir and a dispenser for dispensing liquid soap from the liquid soap reservoir toward the deflector.

Turning now to the drawings, in which like reference characters indicate corresponding elements throughout the several views, attention is first directed to FIG. 1 in which there is seen a spout cover, embodying the principles of the instant invention and generally designated by the reference character 50, as it would appear when attached to a spout, generally designated by the reference character 51. Spout cover 50 is useful for covering spout 51, for providing spout 51 with a pleasing appearance, for providing convenient access to a source of liquid soap, for deflecting water into a basin, such as a tub or sink, associated with spout 51, and for mixing liquid soap, such as liquid bathing soap or liquid bubble bath, into the water flowing from spout 51.

Figures 2, 3, 4, 5:
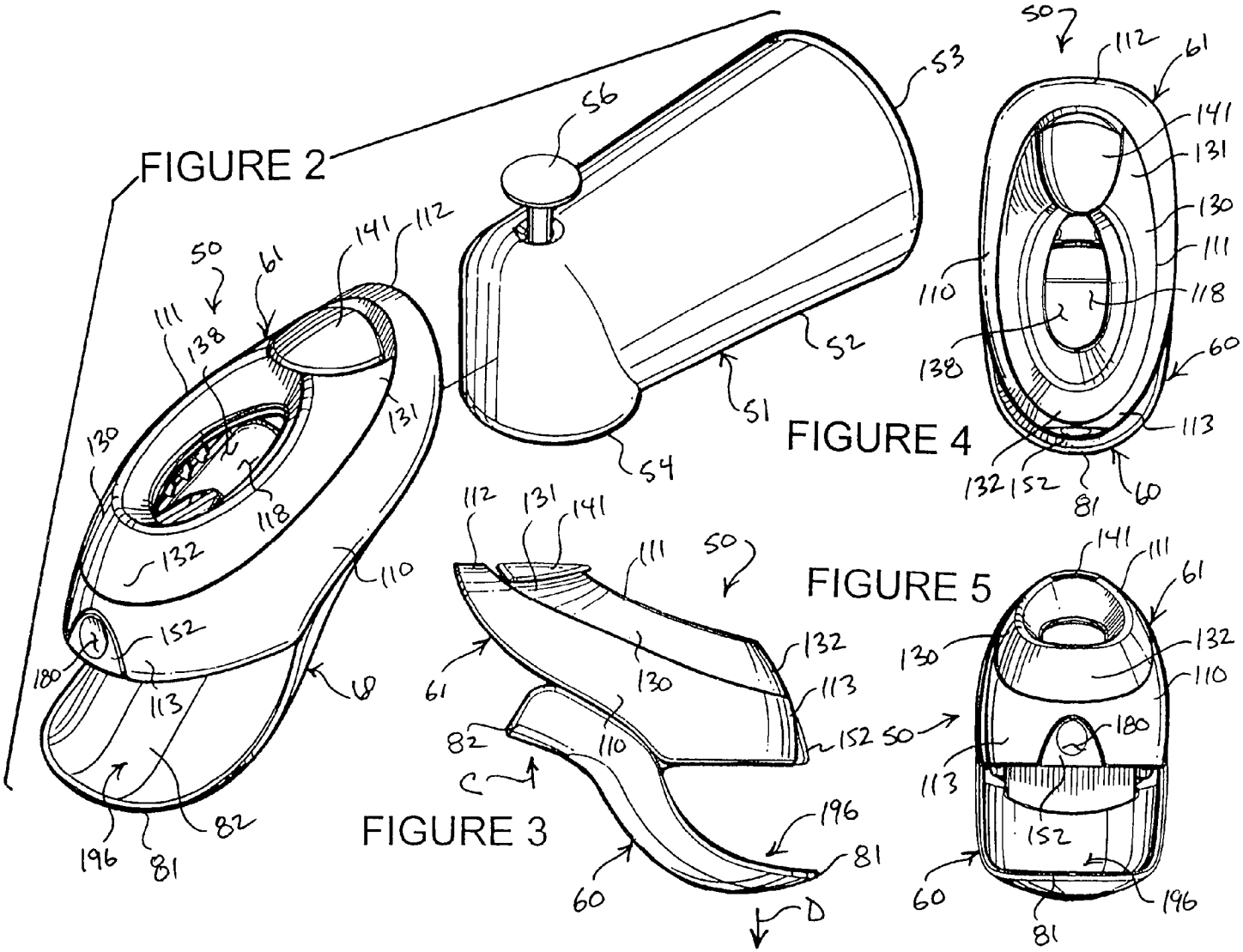
FIG. 2 is a perspective view of the spout cover of FIG. 1 shown as it would appear detached from the spout.
FIG. 3 is a left side elevational view of the spout cover of FIG. 1, the opposing right side elevational view being substantially the same thereof.
FIG. 4 is a top plan view of the spout cover of FIG. 1.
FIG. 5 is a front elevational view of the spout cover of FIG. 1.
Figures 11, 13:
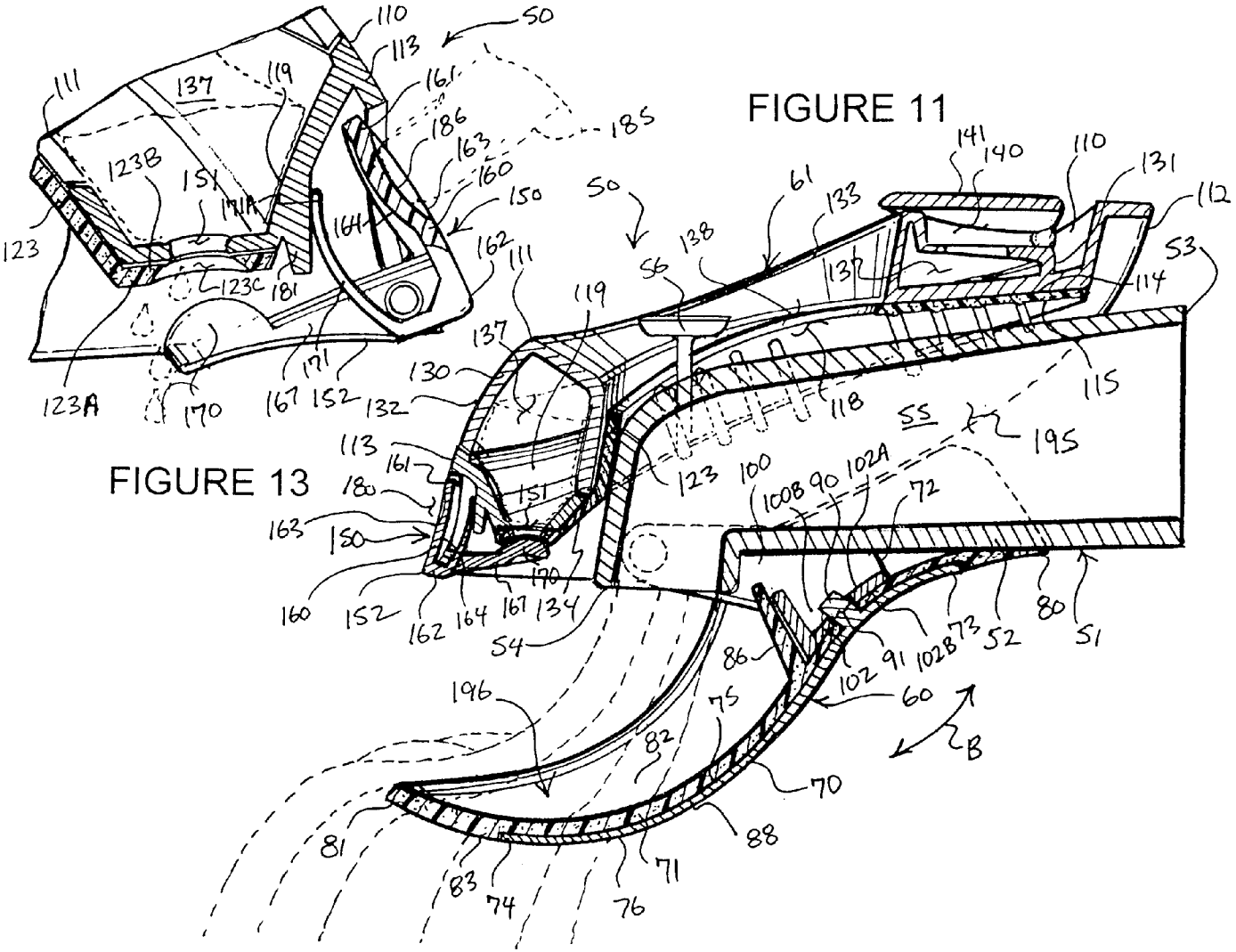
FIG. 11 is a sectional view taken along line 11-11 of FIG. 1 illustrating a dispenser formed in the second member, the dispenser including a flap valve consisting of an outlet, formed in the second member to the liquid soap reservoir, associated with a flap used to open and close the outlet.
FIG. 13 is a view very similar to the view of FIG. 12 showing the flap as it would appear in an open position opening the outlet.

For the purpose of reference and understanding with reference to FIGS. 2 and 11, spout 51 is used in conjunction with a basin, such as a sink or bathtub, and consists of a fixture 52 having an inlet end 53, and an opposing outlet end 54. As referenced in FIG. 11, fixture 52 defines a water-conducting channel 55 extending therethrough from inlet end 53 to outlet end 54. Inlet end 53 is plumbed to a water supply line or pipe, whereby water flows into channel 55 from inlet end 53 and is ejected outwardly from channel 55 through outlet end 54 into the basin. Fixture 52 is furnished with a conventional spigot 56, which is used to plug spout 51, such as for conventionally diverting water to a showerhead. Spout 51 is fashioned of steel, stainless steel, copper, or other conventional materials and utilizing methods standard within the art. Spout 51 is entirely conventional, and is generally representative of conventional spouts commonly used in conjunction with sinks and bathtubs and other forms of basins, further details of which not herein specifically discussed will readily occur to the skilled artisan.

Spout cover 50 consists of two main parts, namely, a first member 60 mounted to a second member 61. Second member 61 overlies first member 60, and together they are adapted to clamp onto spout 51 thereby securing spout cover 50 to spout 51, in accordance with the principle of the invention. The terms "first," in conjunction with first member 60, and "second," in conjunction with second member 61, are not intended to denote an order of importance or quality, but are merely used as convenient identifiers to differentiate one member from the other member.

Figure 9:
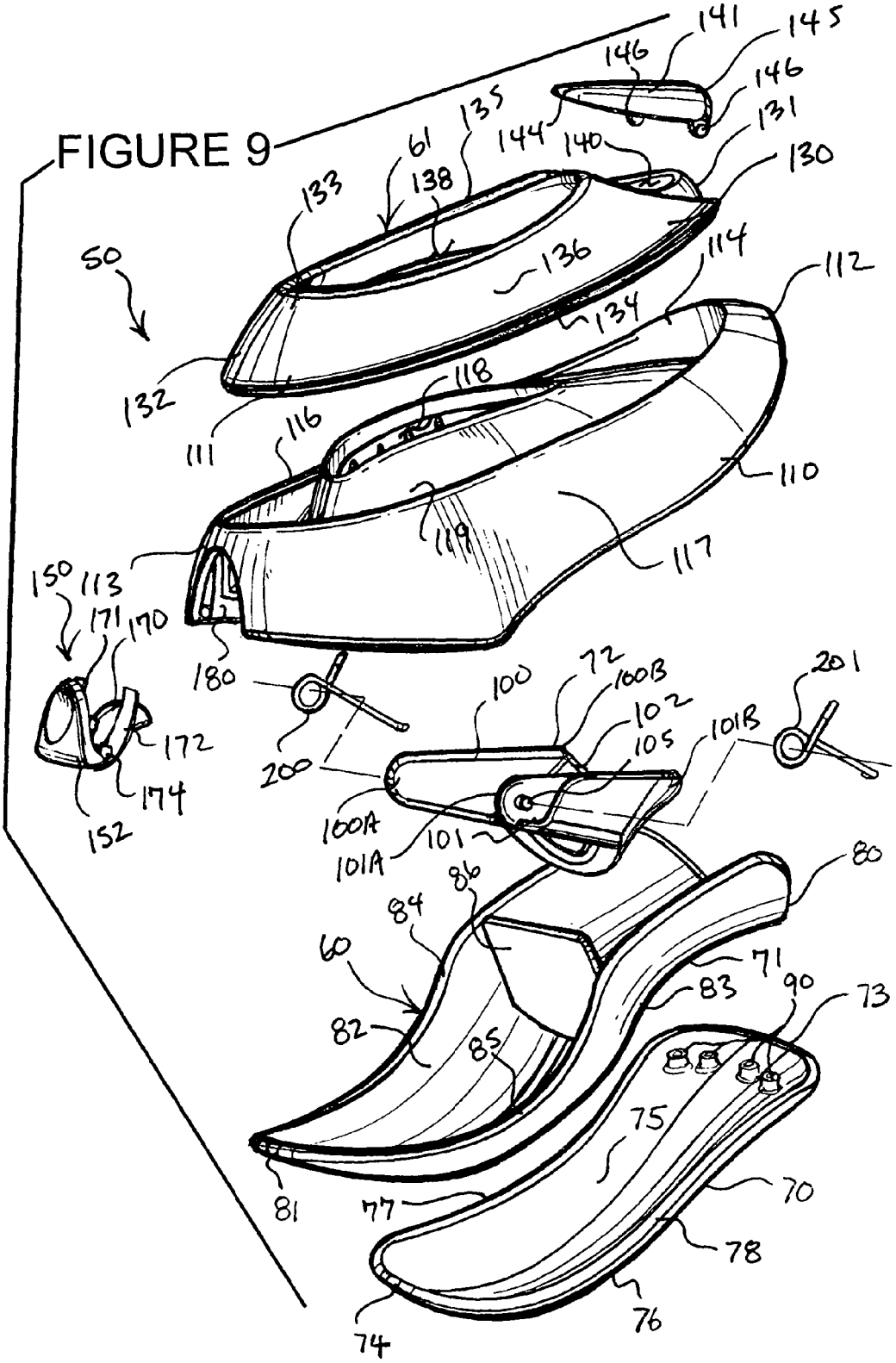
FIG. 9 is an exploded perspective view of the spout cover of FIG. 1.

Referring to FIG. 9, first member 60 consists of three main parts, namely, a base 70, a pan 71, and a coupling 72. Base 70 and coupling 72 are each fashioned of a substantially rigid material, such as plastic, carbon fiber, metal, or other substantially rigid material or combination of materials, and pan 71 is fashioned of a soft, flexible, elastomeric, rubber, and/or foam-like material. Base 70 is a broad, elongate integrated body having a rear end 73, a front end 74, an upper face 75, a lower face 76, and opposed sides 77 and 78. Base 70 has a relatively thin vertical cross section, upper face 75 is generally inwardly curved or bowl-shaped, and lower face 76 is generally outwardly curved.

Pan 71 is considerably larger than base 70, and consists of a broad, elongate integrated body having a rear end 80, a front end 81, an upper face 82, a lower face 83, and opposed sides 84 and 85. Like base 70, pan 71 also has a relatively thin vertical cross section. Upper face 82 of pan 71 is generally inwardly curved or bowl-shaped, and lower face 83 is generally outwardly curved. Pan 71 is formed with an upstanding, transverse support vane 86, which projects away from upper face and from side 84 to side 85. Support vane 86 is located at a generally intermediate position between rear end 81 and front end 81 of pan 71, and provides lateral stability to pan 71 preventing sides 84 and 85 thereat from buckling inwardly and spreading apart.

Figures 6, 7, 8:
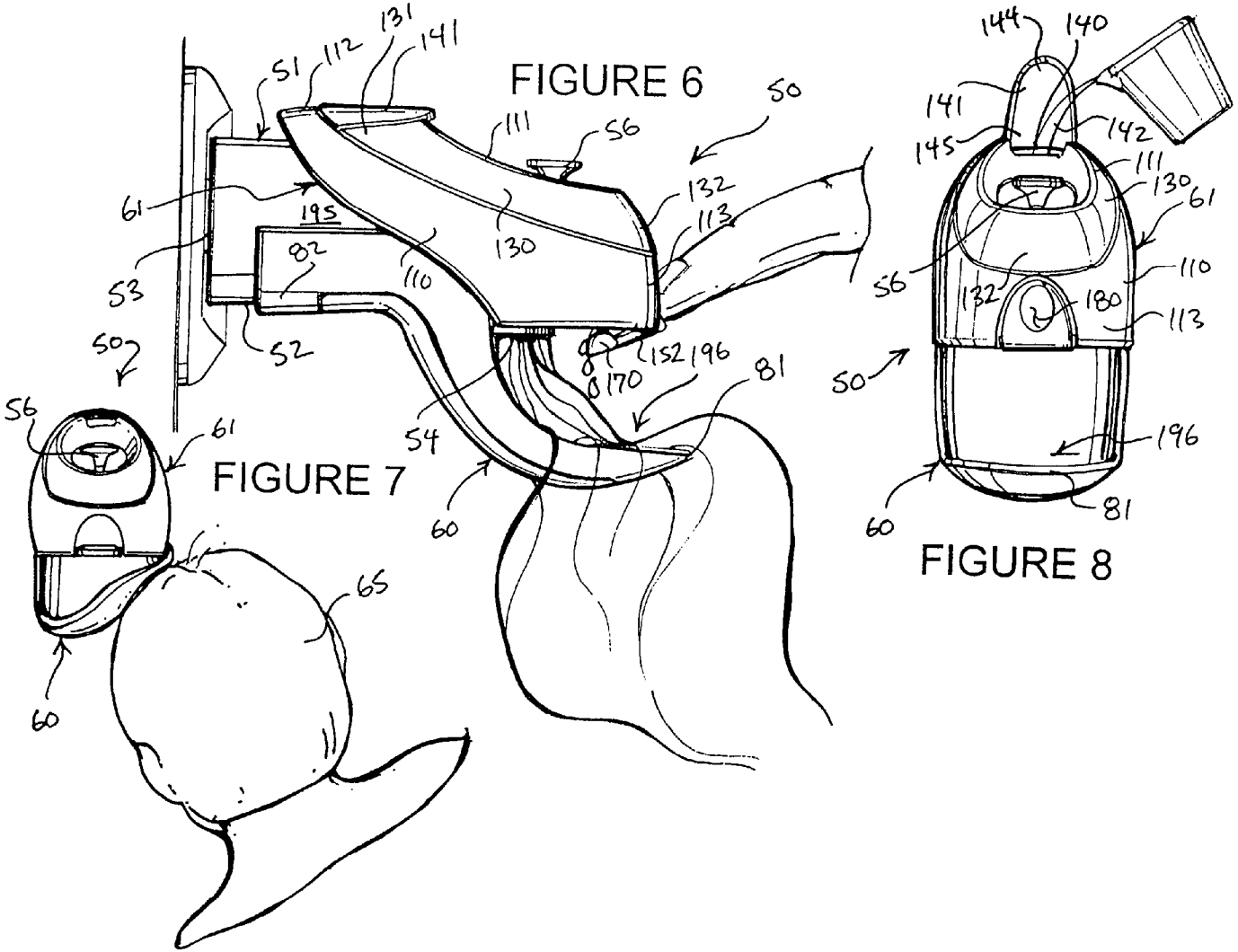
FIG. 6 is a side elevational view of the spout cover of FIG. 1 shown as it would appear in use attached to the spout.
FIG. 7 is a front elevational view of the spout cover of FIG. 1 showing a human head as it would appear hitting the deflector.
FIG. 8 is a front elevational view of the spout cover of FIG. 1 showing a lid as it would appear in an open position opening an inlet to the liquid soap reservoir and liquid soap as it would appear being poured into the liquid soap reservoir through the inlet to the liquid soap reservoir.
Figure 20:
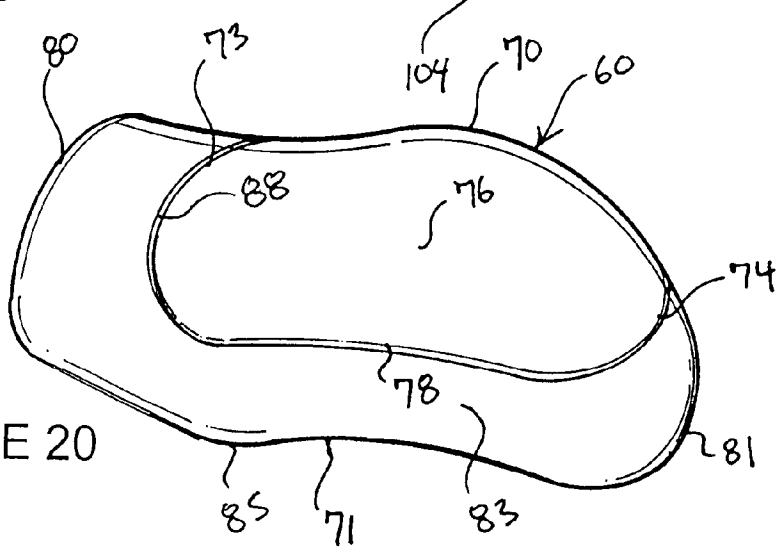
FIG. 20 is a bottom perspective view of the first member of FIG. 19.

Referring to FIG. 11, which is a sectional view taken along line 11-11 of FIG. 1, a centrally-located broad, elongate recess 88 is formed into lower face 83 of pan 71. Base 70 is set upper face 75 first into recess 88, and is adhered thereto with an adhesive. Base 70 can be overmolded with pan 71, if desired. Because pan 71 is soft and flexible and base 70 is substantially rigid, base 70 serves and an underlying substantially rigid support for pan 71. However, because base 70 is significantly smaller than pan 71 and is substantially centrally located on lower face 83, the marginal extremities of pan 71 project radially outwardly from the marginal extremities of base 70, whereby rear end 80, front end 81, and sides 84 and 85 of pan 71, which characterize the marginal extremities of pan 71, are free to deflect relative to base 70 in response to being struck, such as with a human head, hand, or knee. As a matter of example, FIG. 7 illustrates pan 71 as it would appear deflected in response to being struck by a human head 65. FIG. 20 is a bottom perspective view of first member 60 illustrating the attachment of base 70 to lower face 83 of pan 71.

Figure 19:
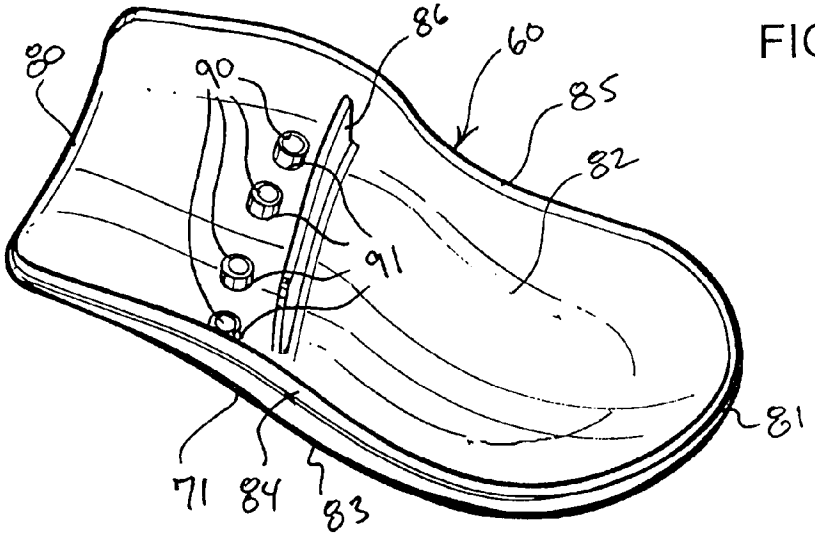
FIG. 19 is a top perspective view of the first member of FIG. 1.

Referring back to FIG. 9, base 70 is formed with a plurality of pins 90, which are located adjacent to rear end 73, and disposed at spaced intervals forming a row extending from adjacent to side 77 to adjacent to side 78. When base 70 is adhered to lower face 83 of pan 71 as previously explained, pins 90 project through a corresponding set of openings 91 formed through pan 71 as shown in FIG. 19, which are located between vane 86 and rear end 80 of pan 71. In the instant embodiment, base 70 incorporates four pins 90 and pan 71 incorporates four corresponding openings 91, although less or more pins 90 and corresponding openings 91 can be used, if desired.

Figures 12, 18, 22, 24:
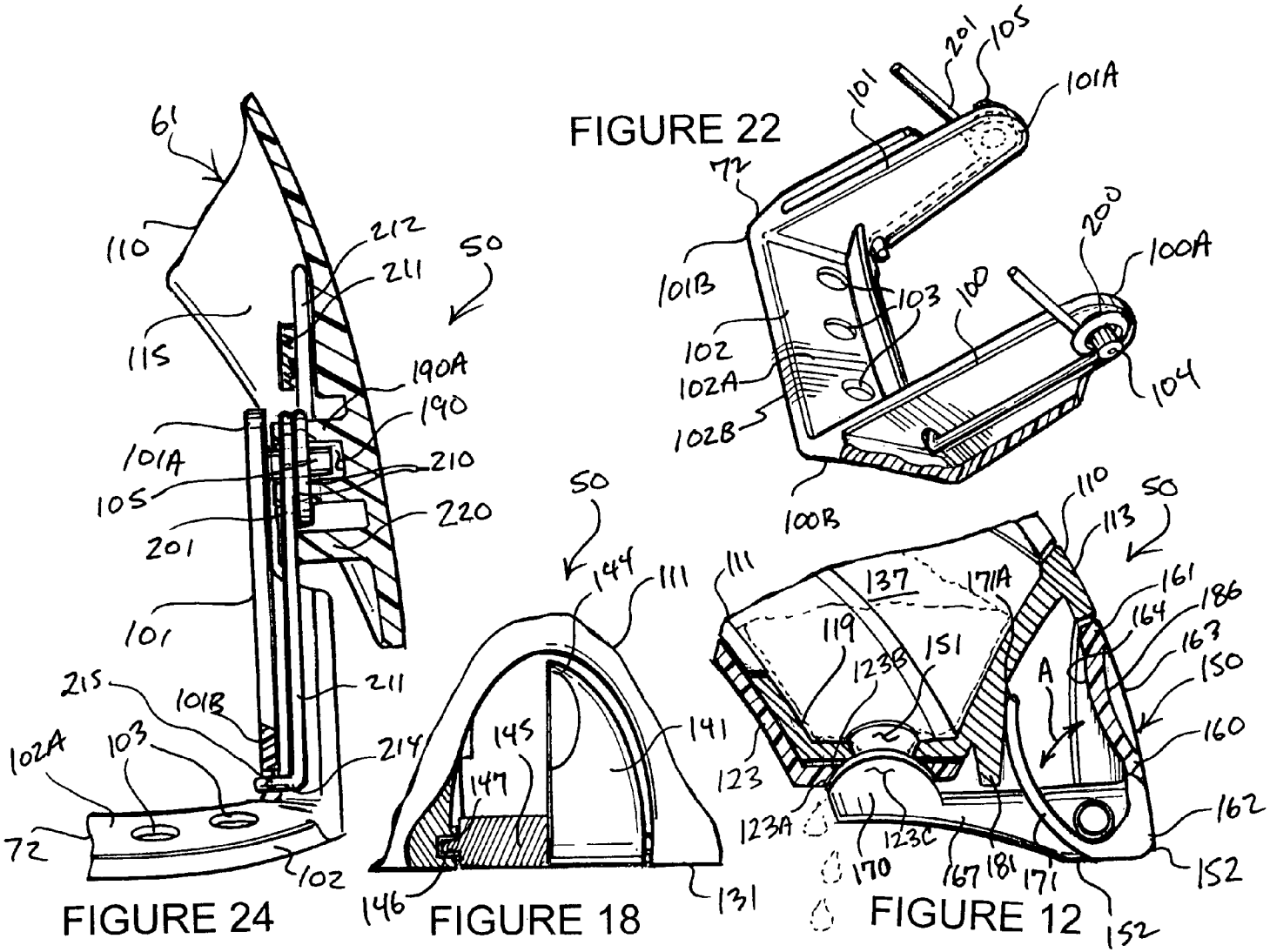
FIG. 12 is fragmentary vertical sectional view of the dispenser of FIG. 11 showing the flap as it would appear in a closed position closing the outlet.
FIG. 18 is an enlarged, fragmentary view of the lid of FIG. 17 shown as it would appear closed closing the inlet to the liquid soap reservoir, in which portions of the lid and the liquid soap reservoir are shown in sectional view for illustrative purposes.
FIG. 22 is a view very similar to the view of FIG. 21 with portions of the coupling broken away for illustrative purposes.
FIG. 24 is a fragmentary sectional view taken along line 24-24 of FIG. 10.
Figure 21:
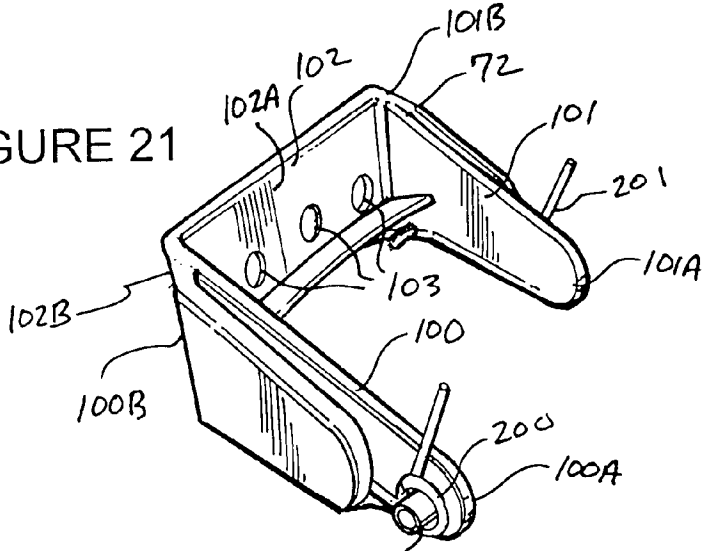
FIG. 21 is a perspective view of the coupling of FIG. 10.

Referring to FIGS. 21 and 22, coupling 72 is an integrated body consisting of opposed, spaced-apart, parallel, substantially coextensive arms 100 and 101 having front ends 101A and 101A, respectively, and rear ends 100B and 101B, respectively. A plate 102, having an upper face 102A and a lower face 102B, interconnects rear ends 100B and 101B, thereby coupling arm 100 to arm 101. Front ends 100A and 101A of arms 100 and 101 are formed with pins 104 and 105, respectively, which project laterally outward therefrom.

Plate 102 is formed with a plurality of openings 103, which extend therethrough from upper face 102A to lower face 102B and which are disposed at spaced intervals and are aligned in a row extending from adjacent to rear end 100B to adjacent to rear end 101B. Openings 103 through plate 102 correspond to pins 90 extending upwardly from upper face 82 through openings 91 formed in pan 71. Lower face 102B of plate 102 is positioned against upper face 82 of pan 71 at pins 90 between vane 86 of rear end 80 of pan 71, and pins 90 concurrently extend into and through openings 103 thereby keying coupling 72 to base 70 in a predetermined position. Lower face 102B of plate 102 is adhered to upper face 82 of pan 71 with an adhesive, and pins 90 are adhered to plate 102 with an adhesive or welding thereby rigidly coupling plate 102 to base 70, in accordance with the principle of the invention. According to the principle of the invention, pan 71 is sandwiched between lower face 102B of plate 102 and upper face 75 of base 70, coupling 72 is rigidly affixed to base 70, arm 100 is located at side 84 of pan 71 and arm 101 is located at side 101 of pan 71, in which arms 100 and 101 extend outwardly away from inner face 82. Arms 101 and 101 are angled forwardly toward front end 81 of pan 71.

Because there are four pins 90 in the instant embodiment, there are, therefore, four corresponding openings 103 in plate 102. In FIGS. 21 and 22, only three openings 103 are shown, with the understanding that the fourth opening is concealed by arm 101.

Referring to FIG. 9, second member 61 consists of two main parts, namely, a base 110 and a hat 111. Base 110 and hat 111 are each fashioned of plastic, carbon fiber, metal, or other substantially rigid material or combination of materials. Preferably, hat 111 is fashioned of transparent, rigid plastic for reasons that will be discussed later in this specification.

Figures 14, 15, 16:
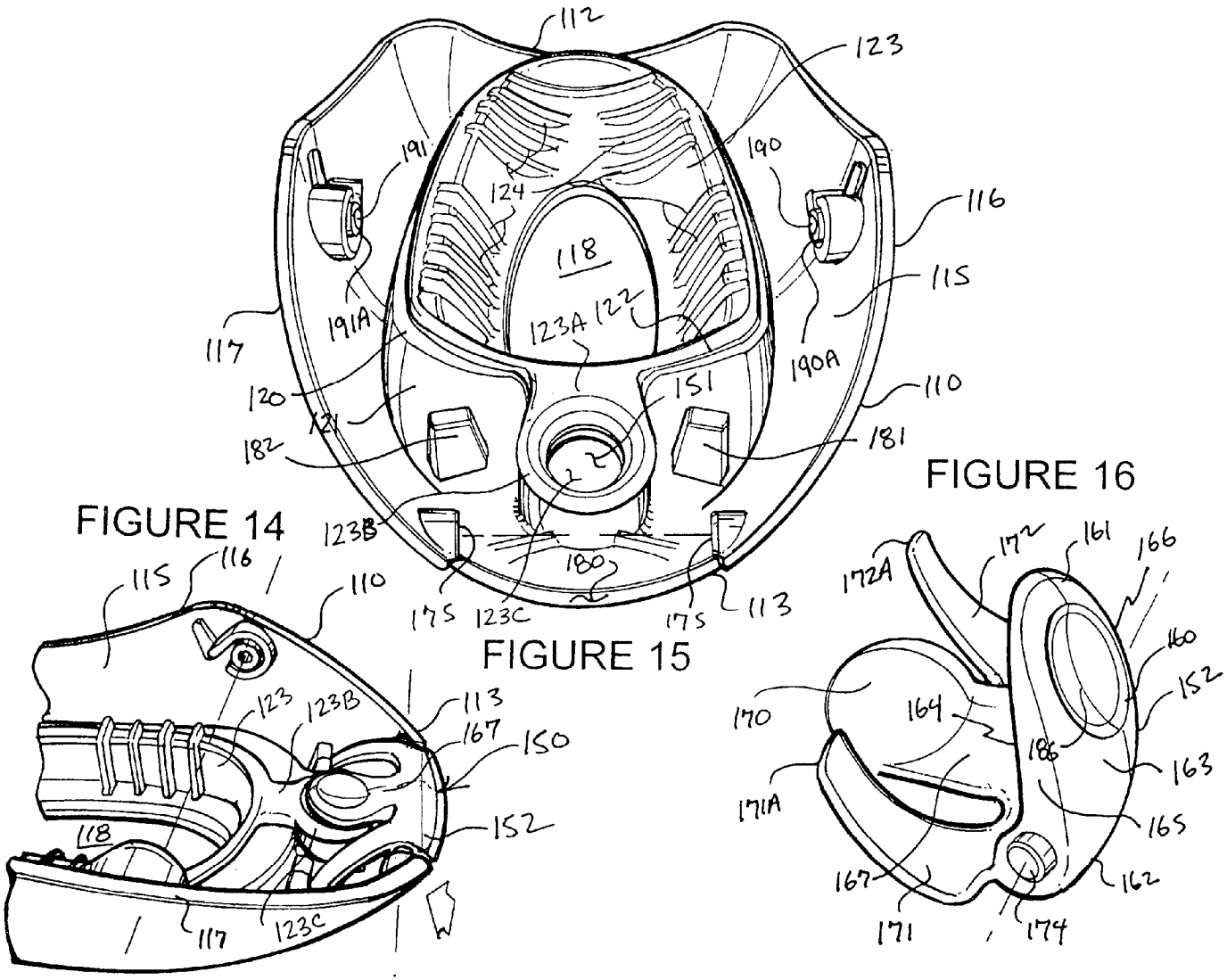
FIG. 14 is a fragmentary perspective view of the second member of FIG. 11 illustrating the dispenser.
FIG. 15 is a fragmentary perspective view of the second member of FIG. 11 shown as it would appear with the flap removed therefrom illustrating the outlet leading from the liquid soap reservoir.
FIG. 16 is an enlarged perspective view of the flap of the dispenser of FIG. 11.

Base 110 is a broad, elongate integrated body having a rear end 112, a front end 113, an upper face 114, a lower face 115 as illustrated in FIG. 15, and opposed sides 116 and 117. The integrated body forming base 110 is a essentially a shell. A central opening 118 is formed in base 110, which extends therethrough from upper face 114 to lower face 115, and which is encircled by an annular valley or trough 119 formed in upper face 114. Referring to FIG. 15, it is seen that trough 119 (not shown in FIG. 15) formed in upper face 144 results in the formation of a raised annular mountain 120 formed in lower face 15, which has an outer annular surface 121 directed outwardly toward the marginal extremities of base 110 and an inwardly directed annular surface 122 directed inwardly facing opening 118. A corresponding annular boot 123 is applied to annular surface 122 covering annular surface 122. Annular boot 123 is an integrated body fashioned of a soft, flexible, elastomeric, rubber, and/or foam-like material, and is formed with a pattern of raised ribs or protuberances 124 as illustrated. Annular boot 123 is adhered to annular surface with adhesive, or by overmolding annular surface 122 with annular boot 123. Although boot 123 is an integrated body in the preferred embodiment, boot 123 may be fashioned of two or more separate attached parts, if desired, in which each separate part functions with the others thereby forming a boot in accordance with the teachings of the invention. If boot 123 is fashioned of two or more separate attached parts, they can, if desired, be disposed at spaced intervals without departing from the term "boot" according to the teachings of this disclosure.

Hat 111 consists of an inverted, generally-U shaped, continuous and generally oblong shell 130 having a rear end 131, a front end 132, a top 133, a bottom 134, and opposed sides 135 and 136. Bottom 134 is open as seen in FIG. 11, and shell 130 defines a central opening 138 extending therethrough. Referring to FIG. 11, shell 130 is set bottom 134 first into trough 119, in which shell 130 forms a dome overlying and enclosing trough 119, and in which trough 119 and shell 130 together define a liquid soap reservoir 137 between in second member 61. Opening 118 defined by base 110 and opening 138 defined by shell 130 are coaxial and substantially coextensive and together constitute and define an access opening through second member 61. Shell 130 and trough 119 are comparably sized, in which bottom 134 fits into trough 119 like one puzzle piece fits into another. After shell 130 is set bottom 134 first into trough 119, bottom 134 is adhered to thereto, with an adhesive or welding, thereby sealing reservoir 137. The combined assembly of shell 130 with base 110 constitutes a body, in accordance with the principle of the invention. Although the body forming second member 61 is an assembly of shell 130 and base 110, shell 130 and base 110 can be integrally formed, if desired. Reservoir 137 is used to hold liquid soap.

With continuing reference to FIG. 11, rear end 131 of shell 130 is formed with an inlet 140. A lid 141, which is depicted in FIGS. 1-4, 6, 8-10, 11, and 17, is mounted to rear end 131 for pivotal movement between a lowered or closed position closing inlet 140 as best seen in FIG. 11, and a raised or open position opening inlet 140 as seen in FIGS. 8 and 17 for allowing liquid soap 142 (FIG. 8) to be poured into reservoir 137 (not referenced in FIG. 8) through inlet 140 for containment therein. Lid 141 is a closure for inlet 140. Inlet 140 at rear end 112 of base 110 communicates with reservoir 137.

Referring briefly to FIGS. 17 and 18, lid 141 has a front end 144 and an opposing rear end 145. The opposed sides of rear end 145 are each fashioned with a boss 146, which is received into a corresponding recess 147 formed in rear end 131, thereby providing the pivotal attachment of lid 141 to shell 130. Although bosses 146 are carried by lid 141 and the corresponding recesses 147 are formed in shell 130, this can be reversed, if desired. Those having regard for the art will readily appreciate that other conventional and well-known forms of pivotal attachments or hinges can be used between lid 141 and rear end 131 of shell 130 for providing the pivotal attachment of lid 141 to shell 130 without departing from the invention.

Referring back to FIG. 11, second member 61 incorporates a dispenser, designated generally by the reference character 150, for dispensing liquid soap from reservoir 137. Dispenser 150 is located at front end 113. In this particular embodiment, dispenser 150 is a flap valve consisting of an outlet 151 formed through the underside of trough 119 at front end 113, and a flap 152 mounted to front end 113 of base 110, which is movable between a closed position closing outlet 151 and open position opening outlet 151 thereby allowing liquid soap to dispense outwardly from reservoir 137 through outlet 151. Outlet 151, which is best illustrated in FIGS. 12, 13, and 15, communicates with reservoir 137.

Looking to FIG. 16, flap 152 is an integrated body fashioned of plastic or resilient material, and consists of a button 160 having an upper end 161, a lower end 162, an outer face 163, an inner face 164, and opposed sides 165 and 166. An arm 167 is attached to lower end 162 of button 160, and projects away from inner face 164 terminating with a plug 170. Opposed, coextensive, parallel, elongate, flexural fingers 171 and 172 attached to lower end 162 of button 160 at sides 165 and 166, respectively, project away from inner face 164 of button 160 on either side of plug 167. Fingers 171 and 172 are arcuate, and arch upwardly relative to plug 167 terminating with front ends 171A and 172A, respectively.

Looking to FIG. 9, front end 113 is formed with a window 180. Flap 152 is attached to front end 113, whereby button 160 is received in window 180. Lower end 162 of button is located at bottom 134 of base 110, and extends upwardly therefrom through window 180 to upper end 161, in which outer face 163 of button 160 faces outwardly and inner face 164 of button 160 faces inwardly toward outlet 151.

Sides 165 and 166 of button 160 are each fashioned with a boss 174. Boss 174 at side 165 is depicted in FIG. 16, and boss 174 at side 166 is depicted in FIG. 9. Bosses 174 are located at lower end 162 of button 160, which are received into corresponding sockets 175 (FIG. 15) formed on lower face 15 at front end 113 of base 110 at bottom 134 on either side of window 180, thereby providing a pivotal attachment of lower end 162 of button 160 to front end 113 of base 110. Referring to FIG. 12, arm 167 extends rearwardly away from inner face 164 of button 160 to plug 170, which is located at outlet 151.

Flap 152 pivots at lower end 162 of button 160 relative to front end 113 of base 110 in reciprocal directions as generally indicated by the arcuate, double-arrowed line A in FIG. 12 between a closed position as shown in FIG. 12 and an open position as seen in FIG. 13. In the closed position of flap 152 as shown in FIG. 12, plug 170 is positioned against outlet 151 thereby plugging/closing outlet 151 preventing liquid soap from flowing outwardly from reservoir 137 through outlet 151. In the open position of flap 152 as shown in FIG. 13, upper end 161 of button 160 is pivoted inwardly and arm 167 is pivoted downwardly positioning plug 170 away from outlet 151 thereby unplugging/opening outlet 151 allowing liquid soap to flow outwardly from reservoir 137 through outlet 151. To pivot flap 152 from its closed position to its open position, an inwardly directed force is applied against outer face 163 of button 160, such as with a finger, which is illustrated in dotted outline in FIG. 13 are referenced by the reference character 185. Outer face 163 is formed with an indentation 186 between upper and lower ends 161 and 162 of button 160 for receiving the tip of a finger for pressing button 160.

Referring to FIGS. 14 and 15, boot 123 is formed with an extension 123A, which leads to an annular seal 123B disposed on the underside of trough 119 as best seen in FIGS. 12 and 13. Seal 123B defines an opening 123C, which is coaxial with outlet 151. In the closed position of flap 152, plug 170 seats against seal 123B thereby preventing liquid soap in reservoir 137 from leaking past plug 170 through outlet 115.

Although seal 123B forms part of boot 123, it may be a separate, stand-alone part not forming part of boot 123, if desired.

As best seen in FIG. 14, fingers 171 and 172 extend rearwardly away from inner face 164 of button 160 to front ends 171A and 172A, respectively, which engage corresponding stops 181 and 182, respectively, formed in lower face 115 on either side of outlet 151 as shown in FIG. 15 and which project outwardly from lower face 115. The flexural character of fingers 171 and 172 cause fingers 171 and 172 to act as springs. In this regard, front ends 171A and 172A act against stops 181 and 182 biasing flap 152 into its closed position. Accordingly, after applying a force to outer face 163 of button 160 sufficient to overcome the bias applied by fingers 171 and 172 to pivot flap 152 from its closed position to its open position for dispensing liquid soap from reservoir 137 through outlet 151, removal of the applied force against outer face 163 of button 160 allows front ends 171A and 172A of fingers 171 and 172 to act against stops 181 and 182 pivoting flap 152 back into its closed position, in accordance with the principle of the invention.

Although bosses 174 are carried by flap 152 and the corresponding sockets 175 are formed in front end 113 of base 110, this can be reversed, if desired. Those having regard for the art will readily appreciate that other conventional and well-known forms of pivotal attachments or hinges can be used between flap 152 and front end 113 of base 110 for providing the pivotal attachment of lid flap 152 to front end 113 of base 110 without departing from the invention. Furthermore, although the bias applied to flap 152 biasing flap 152 into its closed position closing outlet 151 is furnished by fingers 171 and 172, other forms of springs may be used to supply the applied bias without departing from the invention. Still further, although two fingers 171 and 172 and two corresponding stops 181 and 182 are employed in the immediate embodiment, less or more corresponding pairs of fingers and stops can be used without departing from the invention.

Referring back to FIG. 9, coupling 72 is used to couple first member 60 to second member 61. To couple first member 60 to second member 61, first member 60 is positioned underneath second member 61 confronting lower face 115 as shown in FIG. 11, in which upper face 82 of first member 60 faces lower face 115 of second member 61, rear end 82 of first member 60 opposes rear end 112 of second member 61, and front end 81 of first member 60 opposes front end 113 of second member 61. Pins 104 and 105 carried by front ends 101A and 102A of arms 101 and 102, respectively, as shown in FIG. 22, are received into corresponding sockets 190 and 191 formed in corresponding bosses 190A and 191A formed on lower face 15 of base 110 at sides 116 and 117, respectively, thereby providing a pivotal attachment of coupling 72 to base 110 and, therefore, a pivotal attachment of first member 60 to second member 61 and thereby forming spout cover 50 as seen in FIGS. 1-11. FIG. 3 is a left side elevational view of spout cover 50, the opposing right side elevational view being substantially the same thereof, FIG. 4 is a top plan view of spout cover 50, and FIG. 5 is a front elevational view of spout cover 50. It is to be understood that although sockets 190 and 191 formed in bosses 190A and 191A are carried by second member 61 and the corresponding pins 104 and 105 are carried by front ends 100A and 101A of arms 100 and 101, this can be reversed, if desired.

As seen in FIG. 15, bosses 190A and 191A are located at a generally intermediate position relative to rear and front ends 112 and 113 of second member 61, in which first member 60 opposes and lies directly underneath second 61 as shown in FIG. 11. Referring to FIG. 11, front end 81 of first member 60 underlies and opposes front end 113 of second member 61 and dispenser 150, whereby when dispenser 150 is opened liquid soap is dispensed toward upper face 82 of first member 60 from liquid reservoir 137 through outlet 151. The portion of first member 60 at front end 81 opposing and underlying front end 113 of second member 61 and dispenser 150 is a deflector or deflector portion of first member 60, according to the principle of the invention, which is denoted generally by the reference character 196. First member 60 is generally S-shaped in the preferred embodiment set forth herein, whereby the deflector 196 of first member 60 at front end 81 underlies, opposes, and is spaced from and substantially parallel to front end 113 and dispenser 150 and rear end 112 of first member is directed upwardly toward lower surface 115 of base 110 of second member 61.

First member 60 and second member 61 define a receiving area therebetween, which is generally designated by the reference character 195 in FIG. 11. Receiving area 195 is generally defined between boot 123 and upper face 82 of first member 60, and extends into spout cover 50 from the rear ends 80 and 112 of first and second members 60 and 61, respectively, to the inner surface of boot 123 toward front end 113 of second member 61.

Figure 10:
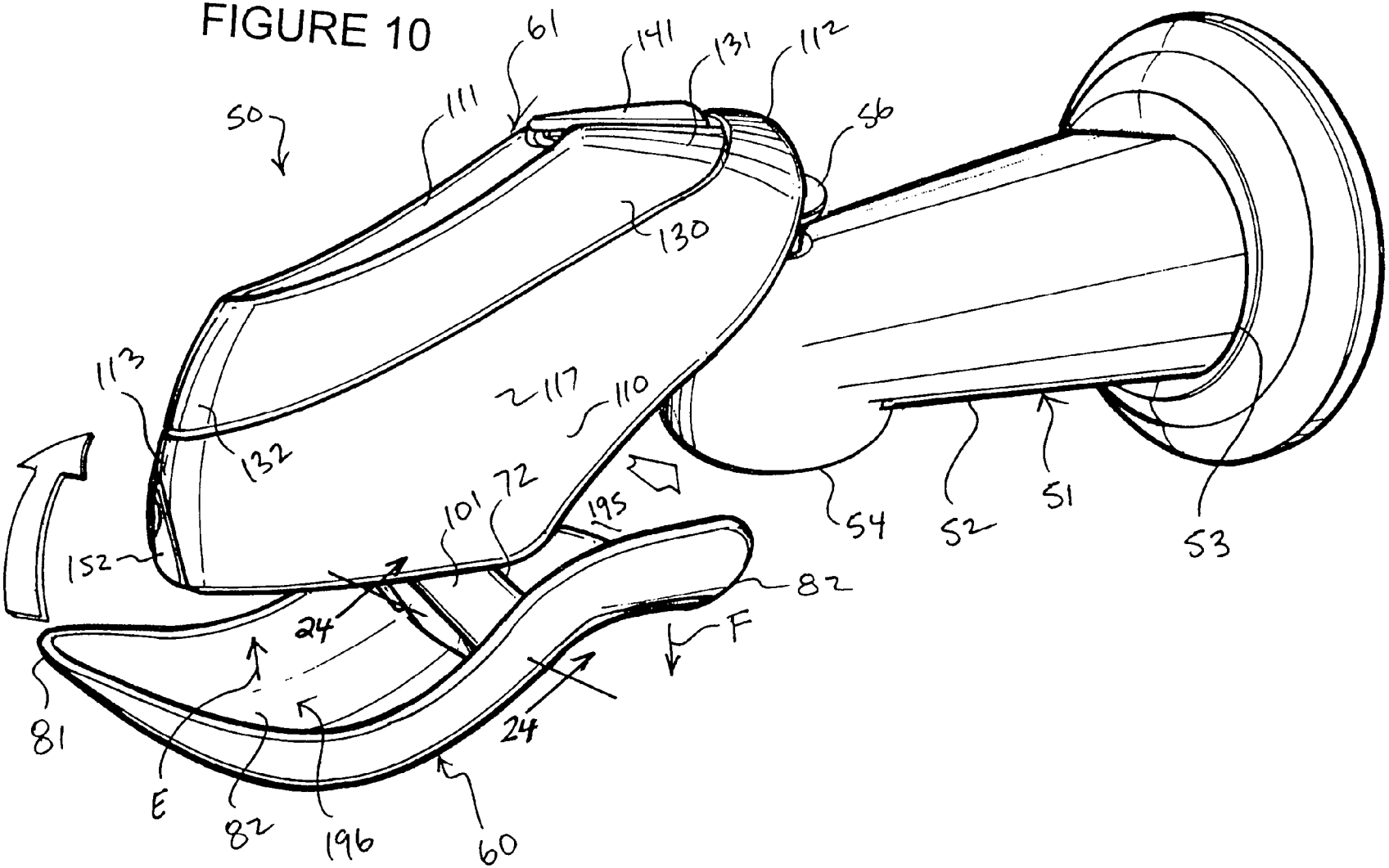
FIG. 10 is a perspective view of the spout cover of FIG. 1 shown as it would appear detached from the spout and the first member, which is coupled to the second member with a coupling, disposed in an open position relative to the second member.

First member 60 pivots at the pivotal connection between front ends 100A and 101A of arms 100 and 101 of coupling 72 and second member 61 relative to second member 61 as generally indicated by the double arrowed line B in FIG. 11 between an open position as seen in FIG. 10 and a closed position as seen in FIG. 3. In other words, first member 61 is movable relative to second member 61 between open and closed positions. In the closed position of first member 60 as shown in FIG. 3, rear end 80 of first member 60 is pivoted upwardly relative to second member 61 in the direction indicated by the arrowed line C against base 110 and the deflector 196 of first member 61 at front end 81 of first member 60 is pivoted downwardly relative to second member 61 away from front end 113 of second member 61 in the direction indicated by the arrowed line D. In the open position of first member 60 as shown in FIG. 10, the deflector 196 of first member 61 at front end 81 of first member 60 is pivoted downwardly relative to second member 61 away from front end 113 of second member 61 in the direction indicated by the arrowed line E, and rear end 80 of first member 60 is pivoted downwardly relative to second member 61 in the direction indicated by the arrowed line F away from base 110. In the closed position of first member 60, receiving area 195 between first and second members 60 and 61 is narrowed, and in the open position of first member 60 receiving area 195 between first and second members 60 and 61 is widened or enlarged.

According to the principle of the invention, a bias is applied to first member 60 biasing first member 60 into its closed position. In the instant embodiment, the bias applied to first member is furnished to a pair of springs, which are generally illustrated in FIG. 9 and denoted by the reference characters 200 and 201, respectively. Springs 200 and 201 interact between first and second members 60 and 61 together biasing first member 60 into its closed position. In the immediate embodiment, two springs are employed, and less or more can be used, if desired.

Spring 200 is associated with the pivotal connection between front end 100A of arm 100 of coupling 72 and second member 61, and spring 201 is associated with the pivotal connection between front end 101A of arm 101 of coupling 72 and second member 61. The details concerning springs 200 and 201 are identical. Accordingly, the structural details of spring 201 will be immediately described with the understanding the ensuing discussion applies equally to tension spring 200 and common structural features are therefore denoted with the same reference characters.

Referring to FIG. 24, which is a sectional view taken along line 24-24 of FIG. 10, pin 105 is shown received into socket 191. Spring 201 is a tension spring, which includes a wire formed into coils 210 encircling boss 190A. In this specific embodiment, tension spring 80 has two active coils, namely, an inner coil and an outer coil, although less or more coils can be used. Coils 210 lead to tag ends 211 and 212, respectively. Tag end 212 extends from coils 210 along the length of arm 101 to a front end formed with a key 215 that is received into and through a keyhole 215 formed in arm 101 at rear end 101A thereby securing tag end 212 to arm 101. As best seen in FIG. 23, boss 190A and coils 210 are partially concurrently encircled by a sidewall 220 having an abutment against which tag end 212 is received.

Spring 201 is fashioned of spring steel, a nickel-based spring alloy, or other material or combination of materials having a substantially constant moduli of elasticity as is typical with tension springs. Spring 201 applies a forcible impulse against first member 60 and second member 61 at tag ends 211 and 212, respectively, biasing first member 60 into its closed position, and winds in response to movement of first member 60 from its close position to its open position, and unwinds in response to movement of first member 60 from its open position to its closed position. As seen in FIGS. 21, 22, and 24, coupling 72 is formed with a shield 106 opposing arm 101. Tag end 211 is received between shield 106 and arm 101 thereby preventing key 214 from inadvertently dislodging from keyhole 215.

Spout cover 50 is used in conjunction with spout 51 and is installed thereon in FIGS. 1, 6, and 11. To install spout cover 50 to spout 51, spout cover 50 is taken up, such as by hand, and a force is applied to first member 60 sufficient to overcome the bias provided by springs 200 and 201 moving first member 60 from its closed position to its open position as shown in FIG. 10. When first member 60 is so disposed in its open position, receiving area 195 is enlarged and prepared to accept spout 51. With first member 60 in its open position, spout 51 is applied into receiving area 195 in the direction from rear ends 80 and 112, locating first member 60 along the underside of spout 51 and second member 61 along the top side of spout 51 and applying spigot 56 at the access opening of second member 61, until outlet end 54 abuts up against boot 123 toward front end 113 of second member 61 as seen in FIG. 11. After positioning spout cover 50 over spout 51 thereby locating spout into receiving area 195, second member 61 of spout cover 50 is applied against the top side of spout 51 bringing boot 123 into engagement with the top side of spout 51. At this point, the force applied to first member 60 biasing it into its open position is released. In response to releasing first member 60, the bias applied to first member 60 by springs 200 and 201 pivots first member 60 toward its closed position bring rear end 80 into engagement against the underside of spout 51, in which receiving area 195 is narrowed and first and second members 60 and 61 cooperate and clamp onto spout 51 preventing withdrawal of spout 51 from receiving area 195. FIGS. 1, 6, and 11 shown spout cover 50 as it would appear installed with spout 51 forming a combination spout with spout cover assembly. Because pan 71 and boot 123 are each fashioned of a soft, flexible, elastomeric, rubber, and/or foam-like material, they frictionally/grippingly engage the outer surface of spout 51 that in conjunction with the clamping force against spout 51 providing by first and second members 60 and 61 prevents spout cover 50 from detaching from spout 51. To remove spout cover 50 from spout 51, the foregoing operation need only be reversed. Although boot 123 is an integrated body in the preferred embodiment, boot 123 may be fashioned of two or more separate attached parts, if desired.

When spout cover 50 is installed onto spout 51 as herein described, outlet end 54 of spout 51 opposes upper face 82 of first member 60, such that the deflector 196 of first member 60 opposes and is disposed underneath not only front end 113 and dispenser 150 of second member 61 but also outlet end 54 of spout 51, which is located rearwardly or otherwise inwardly of dispenser 150 as shown in FIG. 11. When water is applied to spout 51 at inlet end 53, water flows into channel 55 to outlet end 54, and is applied outwardly therefrom. Because the deflector 196 of first member 60 underlies outlet end 54 of spout 51, water flowing from outlet end 54 is applied to upper face 82 of the deflector 196 of first member 60 as shown in FIGS. 1 and 6 and is deflected outwardly therefrom. Because upper face 82 at deflector 196 is generally bowl shaped, water applied to upper face 82 at deflector 196 is aggressively deflected outwardly into the basin associated with spout 51, in accordance with the principle of the invention.

To introduce liquid soap into the water stream applied to the deflector 196 of first member 60, flap 152 is pressed, such as with a finger as shown in FIGS. 1 and 6, moving flap 152 from its closed position closing the outlet 151 (see FIG. 12) to its open position opening outlet 151 (see FIG. 13) thereby allowing liquid soap to flow outwardly through outlet 151 from reservoir 137 toward the deflector 196 of first member 60. As the liquid soap falls toward the deflector 196 of first member 60, it falls into the water applied to the deflector 196 from outlet end 54 of spout 51 and is mixed therein and carried into the basin associated with spout 51, in accordance with the principle of the invention. The liquid soap maintained in reservoir 137 can be liquid bathing soap or bubble bath, and it may be periodically replenished as needed as previously described by opening lid 141 as shown in FIG. 17, pouring liquid soap into reservoir 137 through inlet 140, and then subsequently closing lid 141. Because hat 111 is preferably transparent as previously mentioned, the amount of liquid soap in reservoir 137 can be visually monitored through hat 111.

It is to be understood that without water flowing onto deflector 196 with spout cover 50 installed over spout 51 as herein described, the positioning of deflector 196 underneath dispenser 150 causes liquid soap dispensed therefrom to fall onto upper face 82 of deflector 196 and thereby be collected on upper face 82 of deflector 196, in accordance with the principle of the invention. In this respect, a predetermined amount of liquid soap may be dispensed onto upper face 82 of deflector 196 before turning ON the water to spout 51. This allows a user control over the amount of liquid soap introduced to the water to be applied to deflector 196 before the water is actually applied to deflector 196.

When spout cover 50 is properly installed in accordance with the teachings of invention as seen in FIGS. 1, 6, and 11, spigot 56 is applied at, namely, extends into and through, the access opening formed by second member 61 thereby allowing it to be accessed and used according to its normal use. Therefore, the application of spout cover 50 to spout 51 does not interfere with the operation of spigot 56, in accordance with the principle of the invention. Furthermore, and as seen in FIG. 11, reservoir 137 is angled downwardly from rear end 112 of second member 61 to front end 113 of second member 61, which causes liquid soap maintained therein to flow downwardly from inlet 140 to outlet 151, in accordance with the principle of the invention.

A spout cover 50 has been disclosed, which is easy to install in conjunction with spout 51, which covers spout 51 and provides it with a pleasing appearance, and which furnishes spout 51 with a supply of liquid soap that can be conveniently dispensed into the water stream applied to deflector 196. When the supply of liquid soap maintained by second member 61 is depleted, it may be conveniently replenished by opening lid 141 and pouring liquid soap into the reservoir 137 of second member 61 through its inlet 140, after which lid 141 may be closed. Furthermore, because pan 71 is soft and flexible and because its marginal edges project radially outwardly from the marginal extremities of base 70, its marginal extremities are thereby free to deflect relative to base 70 in response to being struck, such as with a human head, hand, or knee, which prevents painful injury if first member 60 is struck as illustrated in FIG. 7.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A spout cover for removable installation onto a spout having an outlet end, and a spigot projecting outwardly and upwardly therefrom, the spout cover comprising: a first member for installation below the spout, the first member being pivotally mounted to a second member for installation above the spout; a liquid soap reservoir formed in the second member, further comprising a dispenser for dispensing liquid soap from the liquid soap reservoir, wherein the dispenser comprises a flap valve; a receiving area defined between the first and second members for receiving the spout; the first member being pivotally movable relative to the second member between a first position to admit the spout into the receiving area and a second position to prevent withdrawal of the spout cover from spout, the first member being biased from the first position into the second position to retain the spout cover on the spout once it has been so installed; and an access opening formed in the second member for providing user access to the spigot when the spout is received in the receiving area and the first member is disposed in the second position preventing withdrawal of the spout cover from the spout.

2. The spout cover according to claim 1, wherein the second member has a generally annular body that defines the access opening.

3. The spout cover according to claim 1, further comprising a resilient boot carried by the second member for frictionally retaining the second member to the spout when the spout is received in the receiving area and the first member is disposed in the second position preventing withdrawal of the spout from the receiving area.

4. A spout cover for removable installation onto a spout having an inlet end and an outlet end and a spigot projecting outwardly and upwardly therefrom, the spout cover comprising: a first member that is arranged and configured for installation under the spout; a second member that is arranged and configured for installation above the spout, the first member being pivotally mounted to the second member such that the first member is pivotally moveable between a first position that allows the spout cover to be freely installed onto and removed from the spout and a second position that retains the cover on the spout once it has been installed on the spout; a liquid soap reservoir formed in the second member, further comprising a dispenser for dispensing liquid soap from the liquid soap reservoir, wherein the dispenser comprises a flap valve; at least one spring for biasing the first member from the first position into the second position; and an access opening located in the second member and arranged and configured to provide user access to the spigot without removing the spout cover when the spout cover is installed on the spout, wherein the second member has a generally annular aperture located therein and extending there through that defines the access opening.

5. A spout cover as defined in claim 4, wherein the outlet end of the spout extends below the rest of the spout, and wherein the first member engages the spout when the first member is in the second position to prevent the spout cover from being removed from the spout without first moving the first member from the first position to the second position.

6. A spout cover as defined in claim 4, wherein the second member comprises:

a base member; and a hat member mounted on the base member, the liquid soap reservoir being defined intermediate the hat member and the base member.

7. A spout cover as defined in claim 6, wherein the base member has an upper face and a lower face and a central opening formed therein which extends therethrough from the upper face to the lower face, the central opening being encircled by a trough formed in the upper face, and wherein the hat member has a central opening formed therein, wherein the central openings in the base member and the hat member collectively define the access opening.

8. A spout cover as defined in claim 4, additionally comprising:

an inlet located in the second member for filling the liquid soap reservoir; and a lid for selectively opening the inlet for filling the liquid soap reservoir to allow the liquid soap reservoir to be filled or closing the inlet for filling the liquid soap reservoir.

9. A spout cover as defined in claim 4, additionally comprising:

a resilient boot carried by the second member for frictionally retaining the second member to the spout when the spout is received in the receiving area and the first member is disposed in the second position preventing withdrawal of the spout from the receiving area.

10. A spout cover as defined in claim 4, wherein the first member comprises:

a pan member; and a base member mounted under the pan member.

11. A spout cover as defined in claim 10, wherein the pan member is fashioned of a soft, flexible, elastomeric, rubber, and/or foam-like material; and wherein the base member is fashioned of a substantially rigid material, such as plastic, carbon fiber, metal, or other substantially rigid material or combination of materials; and wherein the pan member engages a bottom side of the spout when the first member is in the second position.

12. A spout cover as defined in claim 4, wherein the first member extends under the outlet end of the spout to deflect water flowing out of the outlet end of the spout.

13. A spout cover for removable installation onto a spout having an inlet end and an outlet end and a spigot projecting outwardly and upwardly therefrom, the spout cover comprising:

a first member that is arranged and configured for installation under the spout;

a second member that is arranged and configured for installation above the spout, the first member being pivotally mounted to the second member such that the first member is pivotally moveable between a first position that allows the spout cover to be freely installed onto and removed from the spout and a second position that retains the cover on the spout once it has been installed on the spout;

at least one spring for biasing the first member from the first position into the second position;

a liquid soap reservoir formed within the second member, the liquid soap reservoir comprising:

a dispenser for dispensing liquid soap from the liquid soap reservoir;

an inlet located in the second member for filling the liquid soap reservoir; and a lid for selectively opening the inlet for filling the liquid soap reservoir to allow the liquid soap reservoir to be filled or closing the inlet for filling the liquid soap reservoir; and an access opening located in the second member and arranged and configured to provide user access to the spigot without removing the spout cover when the spout cover is installed on the spout, the access opening extending through the liquid soap reservoir;

wherein the first member engages the spout when the first member is in the second position to prevent the spout cover from being removed from the spout without first moving the first member from the first position to the second position.

* * * * *